US008651708B2

(12) United States Patent
Utturkar et al.

(10) Patent No.: US 8,651,708 B2
(45) Date of Patent: Feb. 18, 2014

(54) HEAT TRANSFER SYSTEM FOR A LIGHT EMITTING DIODE (LED) LAMP

(75) Inventors: Yogen Vishwas Utturkar, Niskayuna, NY (US); Todd Wetzel, Niskayuna, NY (US); Mehmet Arik, Niskayuna, NY (US); Hendrick Pieter De Bock, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 697 days.

(21) Appl. No.: 12/823,534

(22) Filed: Jun. 25, 2010

(65) Prior Publication Data

US 2011/0242826 A1 Oct. 6, 2011

(51) Int. Cl.

| | |
|---|---|
| ***F21V 17/00*** | (2006.01) |
| ***F21V 29/00*** | (2006.01) |
| ***H01J 7/24*** | (2006.01) |
| ***H01K 1/58*** | (2006.01) |

(52) U.S. Cl.
USPC ..... 362/364; 362/294; 362/373

(58) Field of Classification Search
USPC ..... 313/45–46; 362/294, 364, 373
See application file for complete search history.

(56) References Cited

U.S. PATENT DOCUMENTS

| | | | | |
|---|---|---|---|---|
| 3,104,833 | A * | 9/1963 | Stuart et al. | 362/294 |
| 5,738,436 | A * | 4/1998 | Cummings et al. | 362/294 |
| 6,095,671 | A * | 8/2000 | Hutain | 362/373 |
| 7,547,124 | B2 | 6/2009 | Chang | |
| 7,549,772 | B2 | 6/2009 | Wang | |
| 7,626,208 | B2 | 12/2009 | Yang | |
| 7,658,509 | B2 | 2/2010 | Summers et al. | |
| 7,676,915 | B2 | 3/2010 | Ter-Hovhannissian | |
| 7,688,583 | B1 | 3/2010 | Arik | |
| 7,695,162 | B2 | 4/2010 | Zhang | |
| 2004/0190305 | A1 | 9/2004 | Arik | |
| 2005/0111234 | A1 | 5/2005 | Martin et al. | |
| 2005/0265016 | A1 * | 12/2005 | Rappaport | 362/147 |
| 2006/0044804 | A1 * | 3/2006 | Ono et al. | 362/294 |
| 2007/0242447 | A1 * | 10/2007 | Scholz | 362/33 |
| 2008/0165535 | A1 | 7/2008 | Mazzochette | |
| 2008/0212333 | A1 * | 9/2008 | Chen | 362/373 |

(Continued)

FOREIGN PATENT DOCUMENTS

| | | | |
|---|---|---|---|
| EP | 1881259 | A1 | 1/2008 |
| WO | WO2006114726 | A | 11/2006 |

OTHER PUBLICATIONS

Search Report and Written Opinion from corresponding PCT Application No. PCT/US2011/039757 dated Jul. 6, 2012.

*Primary Examiner* — Karabi Guharay
*Assistant Examiner* — Michael Santonocito
(74) *Attorney, Agent, or Firm* — Mary Louise Stanford

(57) ABSTRACT

A heat transfer system is provided for a LED lamp. The LED lamp includes a board surface to supply heat energy during an operation of the LED lamp. The LED lamp is mounted within a recessed housing that separates a first area having a first temperature from a second area having a second temperature, where the second temperature is lower than the first temperature. The system includes a thermal dissipator positioned within the second area. The system further includes a heat transfer device with a first end mounted to the board surface, and a second end mounted to the thermal dissipator, to transfer the heat energy from the board surface in the first area to the thermal dissipator in the second area, and dissipate the heat energy within the second area.

4 Claims, 9 Drawing Sheets

(56) References Cited

U.S. PATENT DOCUMENTS

| | | | | |
|---|---|---|---|---|
| 2008/0231201 | A1 | 9/2008 | Higley | |
| 2008/0265801 | A1 | 10/2008 | Lee | |
| 2009/0014154 | A1 | 1/2009 | Schick | |
| 2009/0251068 | A1 | 10/2009 | Holec | |
| 2010/0038660 | A1 | 2/2010 | Shuja | |
| 2010/0067191 | A1 | 3/2010 | Arik | |
| 2010/0071883 | A1 | 3/2010 | Vetrovec | |
| 2010/0103667 | A1 | 4/2010 | Thrailkill | |
| 2010/0103674 | A1 | 4/2010 | Lai | |
| 2011/0063831 | A1* | 3/2011 | Cook | 362/235 |
| 2011/0075423 | A1* | 3/2011 | Van De Ven | 362/249.02 |
| 2011/0267828 | A1* | 11/2011 | Bazydola et al. | 362/373 |
| 2012/0206926 | A9* | 8/2012 | Chou | 362/365 |

* cited by examiner

HEAT TRANSFER SYSTEM FOR A LIGHT EMITTING DIODE (LED) LAMP

BACKGROUND OF THE INVENTION

A Light Emitting Diode (LED) lamp is well-known and typically uses multiple LEDs to collectively produce a source of light to illuminate a room. The LED lamp offers performance advantages over competing lighting technologies, such as longer life and higher efficiency, for example. However, unlike other lighting technologies, such as incandescent bulbs, which can operate at temperatures in excess of 1000° C. and can dissipate heat energy as infrared radiation (IR), the LED lamp cannot operate at such high temperatures, nor dissipate heat energy in the form of IR radiation. Thus, LED lamps include a thermal management system, to dissipate heat energy from the surface of LED lamp components, such as LED chips, to ensure that the semi-conductor temperature inside the LED chips does not exceed a temperature threshold.

LED lamps are routinely mounted within a recessed housing, such as in a ceiling of a building. When LED lamps are mounted within such recessed housings, the LED lamp may be positioned within an attic of the building, whose temperature may be as much as 40 or 50 degrees Celsius greater than the temperature in an air-conditioned room below. Conventionally, the heat energy from the LED chips is transferred out from the lamp body, which may have fin surfaces, to the air enclosed between the lamp body and the recessed housing. This air transfers the heat through normal buoyancy air movement to the recessed housing. Ultimately, the recessed housing conducts the heat out to the attic. As appreciated by one of skill in the art, the luminous efficiency of an LED lamp is determined by the LED chip temperature and, subsequently, the efficiency of the thermal management system of the LED lamp.

LED lamps are typically sold based on a desired luminous power output, and a majority of the cost of the LED lamp is based on a minimum number of LEDs required to collectively generate the desired luminous power output. The minimum number of LEDs is based on the efficiency of the thermal management system of the LED lamp. Thus, if the efficiency of the thermal management system is improved, a fewer number of LEDs may be required, which would consequently reduce the consumer cost of the LED lamp.

Accordingly, it would be advantageous to provide an improved thermal management system for LED lamps mounted within a recessed housing, to ensure that the surface temperature of the LED lamp components does not exceed the temperature threshold, while simultaneously reducing the cost of the LED lamps.

BRIEF DESCRIPTION OF THE INVENTION

In one embodiment of the present invention, a heat transfer system is provided for a LED lamp. The LED lamp includes a board surface to generate heat energy during an operation of the LED lamp. The LED lamp is positioned within a lamp body and mounted within a recessed housing which separates a first area having a first temperature from a second area having a second temperature, where the second temperature is lower than the first temperature. The system includes a thermal dissipator positioned within the second area. The system further includes a heat transfer device with a first end mounted to the board surface, and a second end mounted to the thermal dissipator, to transfer the heat energy from the board surface in the first area to the thermal dissipator in the second area, and dissipate the heat energy from the thermal dissipator within the second area.

In another embodiment of the present invention, a heat transfer system is provided for the LED lamp mounted within a recessed housing. The system includes the thermal dissipator positioned within the second area. The system further includes a side wall of the lamp body. The side wall has a first end thermally coupled to the board surface and a second end thermally coupled to the thermal dissipator. The side wall transfers the heat energy from the board surface in the first area to the thermal dissipator in the second area, to dissipate the heat energy from the thermal dissipator within the second area.

In another embodiment of the present invention, a heat transfer system is provided for the LED lamp mounted within a recessed housing. The system includes a trim positioned within the room, and a heat pipe with the first end mounted to the board surface in the attic, and the second end mounted to the trim within the room, to transfer the heat energy from the board surface to the trim and to dissipate the heat energy from the trim within the room. The system further includes an air flow device to generate a flow of air along the trim. The trim directs the generated flow of air in an outward radial direction over the trim, to enhance the dissipation of the heat energy from the trim within the room.

DETAILED DESCRIPTION

Figure 1:
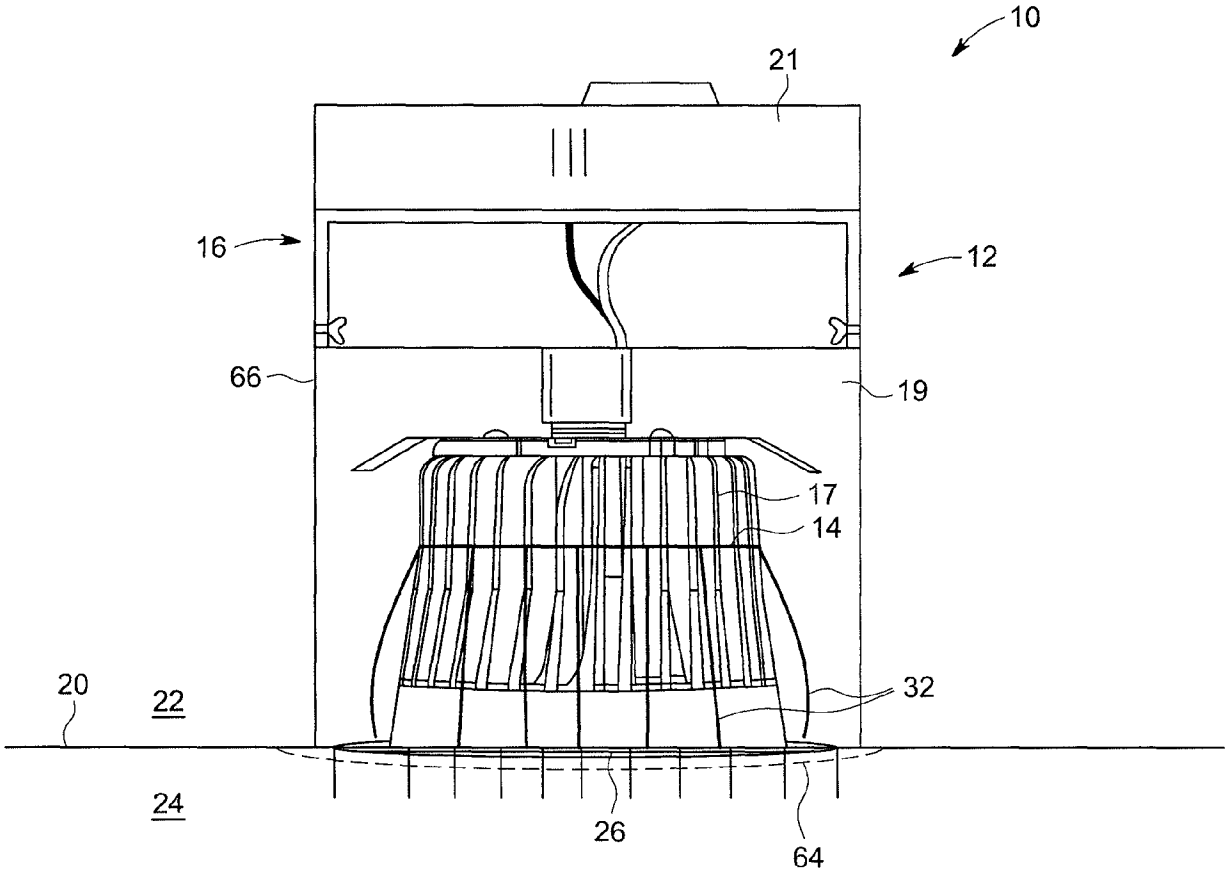
FIG. 1 is a side cutaway view of an exemplary embodiment of a heat transfer system for a LED lamp in accordance with the present invention.

The embodiments of the present invention discuss LED lamps mounted in a recessed fixture in a ceiling of a building, such as in a recessed fixture of the ceiling of a top floor of a building and positioned within an attic area, for example. As discussed in greater detail below, the LED lamp includes one or more LEDs which collectively generate a combined luminous output, when a current is passed through each LED from a power source. The luminous output is based on a ratio of the total optical power output which falls within the human visible spectrum, as appreciated by one of ordinary skill in the art. The LED lamp is positioned within a lamp body, which is itself mounted within the recessed housing, at the opening to the ceiling, as discussed below. During operation of the LED lamp, the surface temperature of each LED increases, and the generated heat at the surface of each LED is not radiated out of the recessed housing in the form of IR radiation, as with an incandescent bulb, for example. Thus, the heat energy at the surface of each LED within the LED lamp needs to be efficiently transferred off the surface of each LED, to prevent the temperature of the surface of the LED from rising above a threshold temperature and damaging the LED. As discussed above, in conventional LED lamps mounted within a recessed housing, the heat energy at the surface of each LED is transferred to the lamp body of the LED lamp, from which the heat energy is subsequently transferred (via. natural convection) to a spacing between the lamp body and the recessed housing, after which the heat energy is subsequently transferred (via natural convection) through the recessed housing to the surrounding area of the attic, whose temperature may be as high as 40-50 degrees Celsius greater than the temperature of the air-conditioned room below. As discussed below, the lamp body typically includes one or more slots or "fins," to enhance the convection of the heat energy to the spacing between the lamp body and the recessed housing.

The inventors of the present invention have recognized that the thermal management systems in conventional LED lamps are inherently limited by the use of the warmer area of the attic to transfer the heat energy from the surface of each LED. The inventors of the present invention have developed a system for enhancing the efficiency of the thermal management of the LED lamp, by utilizing the room below the recessed housing, having a lower temperature than the attic area, to transfer the heat energy from the surface of each LED.

As discussed above, a consumer may purchase an LED lamp, based on a minimum desired lumen output. For example, a 660 lumen LED lamp may cost approximately $100. If the consumer needs more lumen output, such as a 1500 lumen LED lamp, the lamps expected price would be $250, and would use 2.5 times more LEDs than the 660 lumen lamp to generate the required 1500 lumen output, for example. Thus, the LED lamp cost to the consumer is based on the minimum number of required LEDs to generate the desired lumen output.

The inventors have recognized that if the efficiency of the thermal management system within the LED lamp is improved, such that only a fraction of the previously required number of LEDs are needed to generate the minimum desired lumen output, the consumer would save the cost of the unneeded LEDs. For example, if the efficiency of the thermal management system of the 660 lumen LED lamp was enhanced such that only 33% as many LEDs were needed to generate the desired lumen output, the cost of the LED lamp may fall from $100 to $40

Figure 2:
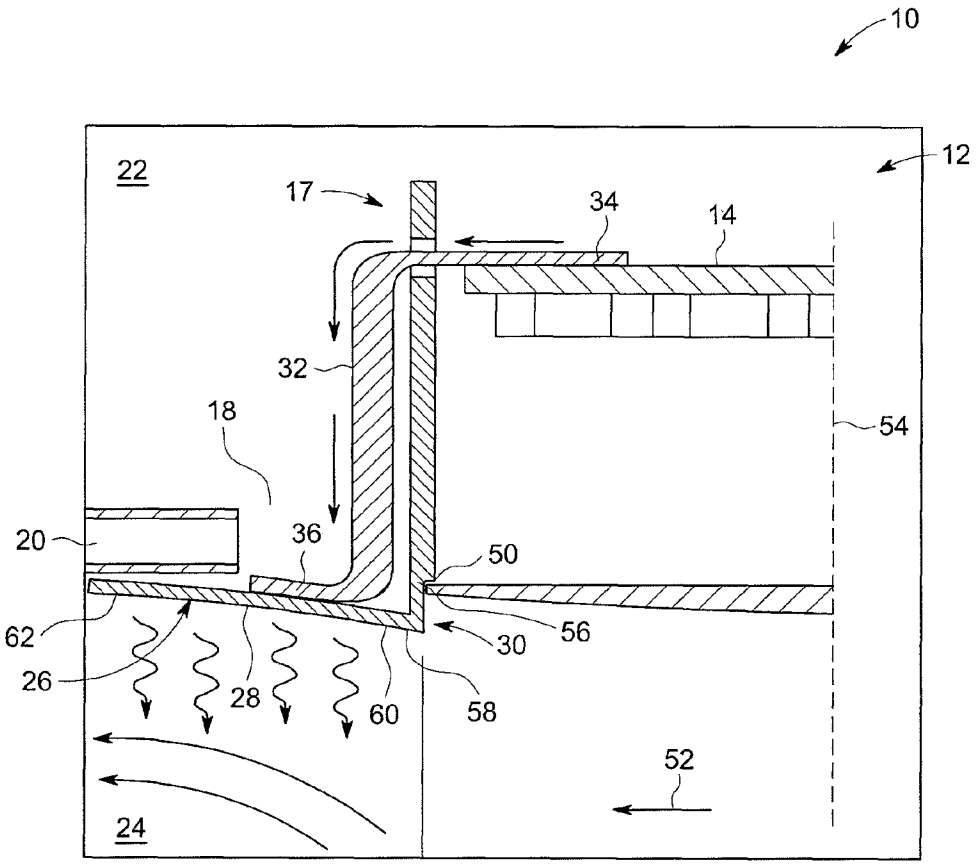
FIG. 2 is a partial-side cross-sectional view of the heat transfer system for the LED lamp illustrated in FIG. 1.

FIGS. 1-2 illustrate a heat transfer system 10 for enhancing a luminous efficiency of a LED lamp 12. The LED lamp 12 includes a board surface 14 which supplies heat energy during an operation of the LED lamp 12. As previously discussed, the LED lamp 12 includes one or more LEDs which are mounted on the board surface 14, and a current is passed through the LEDs from a power source 21, as appreciated by one of skill in the art. The LED lamp 12 is positioned within a lamp body 17 and is mounted within a recessed housing 16 at an opening 18 (FIG. 2) in a ceiling 20. Although FIGS. 1-2 illustrate that the LED lamp 12 is mounted within the recessed housing 16 at the opening 18 in the ceiling 20, the LED lamp may be mounted within the recessed housing at an opening of any interior surface of the room, such as the floor, a side wall, or the ceiling, for example. In an exemplary embodiment, the opening 18 may have an outer diameter of 6", based on the diameter of the recessed housing 16, and an inner diameter of 5" based on the diameter of the lamp body 17, providing a radial gap of 0.5" between the recessed housing 16 and the lamp body 17 around the opening 18. The recessed housing 16 may include a standard Edison-socket, to insert and secure a tip of the LED lamp 12, for example. As further illustrated in FIG. 1, the board surface 14 is mounted within the lamp body 17, and the lamp body 17 is positioned within the recessed housing 16. As discussed above, the lamp body 17 conventionally includes one or more openings on its exterior surface, or "fins," to assist in the dissipation of the heat energy from the board surface 14 to the recessed housing 16. The lamp body 17 accommodates dissipation of the heat energy from the board surface 14 to an area 19 between the lamp body 17 and the recessed housing 16. In an exemplary embodiment, the lamp body 17 may include between 34-36 fins around the outer surface thereof, where each fin has a height of 1 cm, for example.

As further illustrated in FIG. 1, the ceiling 20 separates a first area such as an attic 22 having a first temperature from a second area such as a room 24 having a second temperature, where the second temperature is less than the first temperature. In an exemplary embodiment, the ceiling 20 is a ceiling of a top floor of a building, such that the room 24 is below the ceiling and the attic 22. In an exemplary embodiment, the room 24 is air-conditioned such that the second temperature is less than the first temperature, and in a further exemplary embodiment, the second temperature may be at least 40 degrees Celsius less than the first temperature. However, the room 24 need not be air-conditioned in order for the second temperature to be less than the first temperature. As appreciated by one of ordinary skill in the art, a recessed housing 16 is pre-formed within the ceiling 20 of a top floor of the building, such as a second floor of a two-story home, or a third floor of a three-story home, for example. The embodiments of the present invention are not limited to any specifically sized building. The embodiments of the present invention may be used during a summer season, when the temperature of the attic 22 of a building is typically greater than the temperature of the room 24 below the attic 22 of the building. During other time periods, such as a winter season, for example, when the temperature in the attic 22 is less than the temperature in the room 24 below the attic 22, the system may be disabled, for example, and the thermal management system may default to a mode in which the heat energy from the board surface 14 is transferred to the attic 22, for example.

As further illustrated in FIG. 1, the system 10 includes a trim surface or a thermal dissipator 26 positioned within the room 24. The thermal dissipator 26 is a ring-shaped surface (commonly referred to as trim) attached to the base 50 of the lamp body 17. Although FIG. 1 illustrates that the thermal dissipator 26 and the lamp body 17 are distinct components which are coupled together, the thermal dissipator 26 may be an integrated portion of the lamp body 17. The system 10 further includes a heat transfer device 32 with a first end 34 mounted to the board surface 14, and a second end 36 mounted to the thermal dissipator 26, to transfer the heat energy from the board surface 14 in the attic 22 to the thermal dissipator 26 in the room 24, to dissipate the heat energy from the thermal dissipator 26 within the room 24. In an exemplary embodiment, the first and second ends 34,36 include thermal interface material (TIM), for purposes of mounting the first end 34 to the board surface 14 and the second end 36 to the thermal dissipator 26. More specifically, the TIM material provided at the first and second ends 34,36 may be in the range of 3-5 mm thick, and more specifically, may be approximately 4 mm thick, for example.

As illustrated in FIG. 2, the thermal dissipator 26 includes a longitudinal surface 30 attached to the base 50 of the lamp body 17. The longitudinal surface 30 extends in a direction parallel to a longitudinal axis 54 of the lamp body 17, from a first end 56 attached to the base 50 of the lamp body 17 to a second end 58 within the room 24. The thermal dissipator 26 further includes a radial surface 28 positioned within the room 24, which takes the form of a ring-shaped surface. The radial surface 28 extends in an outward radial direction 52 from a first end 60 at an inner diameter portion integral with the second end 58 of the longitudinal surface 30, to a second end 62 at an outer diameter portion. In an exemplary embodiment, the radial surface 28 may take an arcuate shape, from the first end 60 to the second end 62. A surface area of the radial surface 28 is greater than a threshold surface area required to dissipate the heat energy transferred from the board surface 16 to the thermal dissipator 26, at a threshold rate. The threshold rate is based on the second temperature. For example, the transferred heat from the board surface 16 to the thermal dissipator 26 can be dissipated at a greater threshold rate, if the second temperature of the room 24 is 10 degrees Celsius, rather than if the second temperature of the room 24 is 15 degrees Celsius (assuming the first temperature is constant and greater than 15 degrees Celsius). Although the thermal dissipator 26 of FIG. 1 depicts a ring-shaped radial surface 28, the thermal dissipator is not limited to this configuration, and may take any form, including a square form, a rectangular form, any polygon form, or any non-polygon form, provided that the surface area of the thermal dissipator within the room is greater than the threshold surface area required to dissipate the heat energy transferred from the board surface to the thermal dissipator at the threshold rate. Additionally, the difference between the dissipation rate in the room and the attic can be compared, based on the difference between the second temperature and the first temperature. For example, the dissipation rate difference between the attic and the room is greater where the first temperature is 40 degrees C. and the second temperature is 10 degrees C. (i.e., difference is 30 degrees C.), than if the first temperature is 20 degrees C. and the second temperature is 15 degrees C. (i.e., difference is 5 degrees C.).

As illustrated in FIG. 1, an optional metallic surface 64 covers an area of the ceiling 20 around the opening 18 in the ceiling 20. The area covered by the metallic surface 64 is greater than an area covered by the radial surface 28, such that the second end 62 of the radial surface 28 at the outer diameter portion is coupled to the metallic surface 64, to enhance the dissipation of the heat energy from the thermal dissipator 26 and the metallic surface 64 within the room 24 (i.e., the metallic surface 64 is positioned flush with the ceiling 20 and between the ceiling 20 and the radial surface 28). Thus, in essence, the heat energy is transferred from the board surface 14 and is dissipated from the combined surface area of the radial surface 28 and the metallic surface 64, within the room 24. Although FIG. 1 illustrates that the optional metallic surface 64 takes a similar circular form as the radial surface 28, having a slightly larger outer diameter than the radial surface 28, the optional metallic surface need not take any particular form, provided that the optional metallic surface covers an area greater than an area of the radial surface, such that the second end of the radial surface is coupled to the optional metallic surface.

Figure 3:
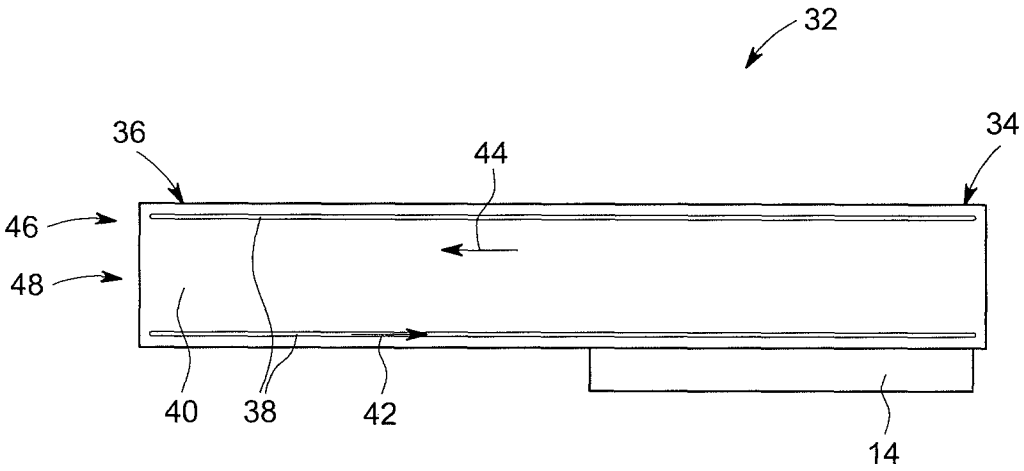
FIG. 3 is a partial-side cross-sectional view of the heat pipe of the heat transfer system for the LED lamp illustrated in FIG. 1.

As illustrated in FIGS. 1-2, the heat transfer device 32 is a heat pipe which employs a two-phase heat transfer to transfer the heat energy from the board surface 14 to the thermal dissipator 26. FIG. 3 illustrates an exemplary embodiment of the heat transfer device 32, such as a vapor chamber, for example, which includes a liquid layer 38 positioned within an outer diameter portion 46 and a vapor layer 40 positioned within an inner diameter portion 48. The liquid layer 38 accommodates a flow of liquid 42 to the first end 34, where the liquid evaporates into a vapor 44 within the vapor layer 40. The vapor layer 40 accommodates a flow of the vapor 44 to the second end 36, where the vapor 44 condenses into liquid 42 within the liquid layer 38. This process is repeated, to transfer heat energy from the first end 34 to the second end 36 of the heat transfer device 32. In an exemplary embodiment, an interior surface of the vapor layer 40 is lined with a wicking material, and the condensed vapor is absorbed by the wicking material at the second end 36, after which the flow of liquid 42 to the first end 34 is accommodated by capillary forces within the wicking material. Although FIG. 3 illustrates the heat transfer device as a vapor chamber arrangement, the heat transfer device is not limited to a vapor chamber arrangement, and includes any heat sink or heat transfer mechanism which is capable of transferring heat from the first end 34 to the second end 36.

Figure 4:
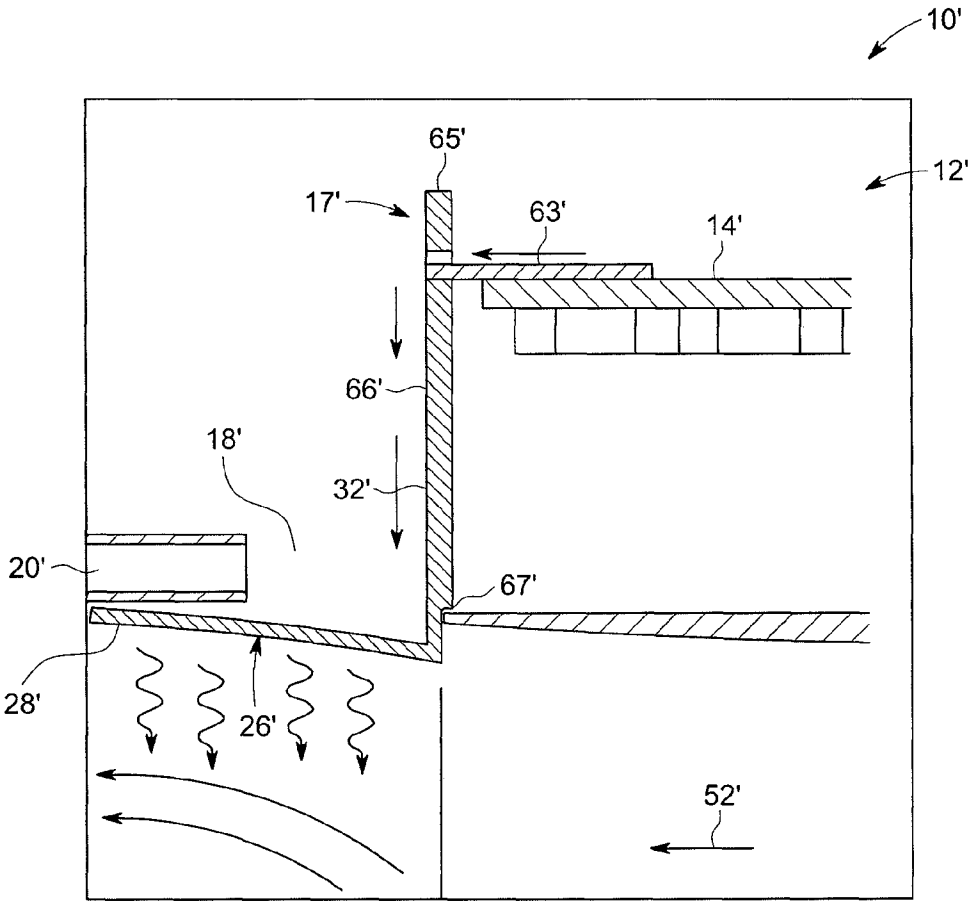
FIG. 4 is a partial-side cross-sectional view of an alternative heat transfer system for a LED lamp in accordance with the present invention.

FIG. 4 illustrates an exemplary embodiment of a heat transfer system 10' having a similar configuration as the heat transfer system 10 of FIGS. 1-2, with the exception that the heat transfer device 32' is positioned within a side wall 66' of the lamp body 17', and thus the separate heat transfer device apart from the recessed housing (as in FIGS. 1-2) is not needed. The side wall 66' of the lamp body 17' includes a first end 65' thermally coupled to the board surface 14' and a second end 67' thermally coupled to the thermal dissipator 26'. As with the heat transfer device 32 in FIGS. 1-2, the side wall 66' transfers the heat energy from the board surface 14' to the thermal dissipator 26', to dissipate the heat energy from the thermal dissipator 26' within the room 24'. In an exemplary embodiment, the side wall 66' is a vapor chamber similar to the vapor chamber illustrated in FIG. 3, to employ a two-phase heat transfer to transfer the heat energy from the board surface 14' to the thermal dissipator 26'. The system 10' includes a thermal coupling 63', to thermally couple the first end 65' of the side wall 66' to the board surface 14'. The thermal coupling 63' may be a piece of conductive material, such as copper, for example. The thermal dissipator 26' may be integral with the lamp body 17', and the side wall 66' and the thermal dissipator 26' may collectively transfer the heat energy from the board surface 14' to the room 24' for dissipation. However, the thermal dissipator 26' may be separate and removably attached to the recessed housing 16'. Those elements of the system 10' illustrated in FIG. 4, and not discussed herein, are similar to the equivalent-numbered elements of the system 10 discussed above, without prime notation, and require no further discussion herein.

Figure 5:
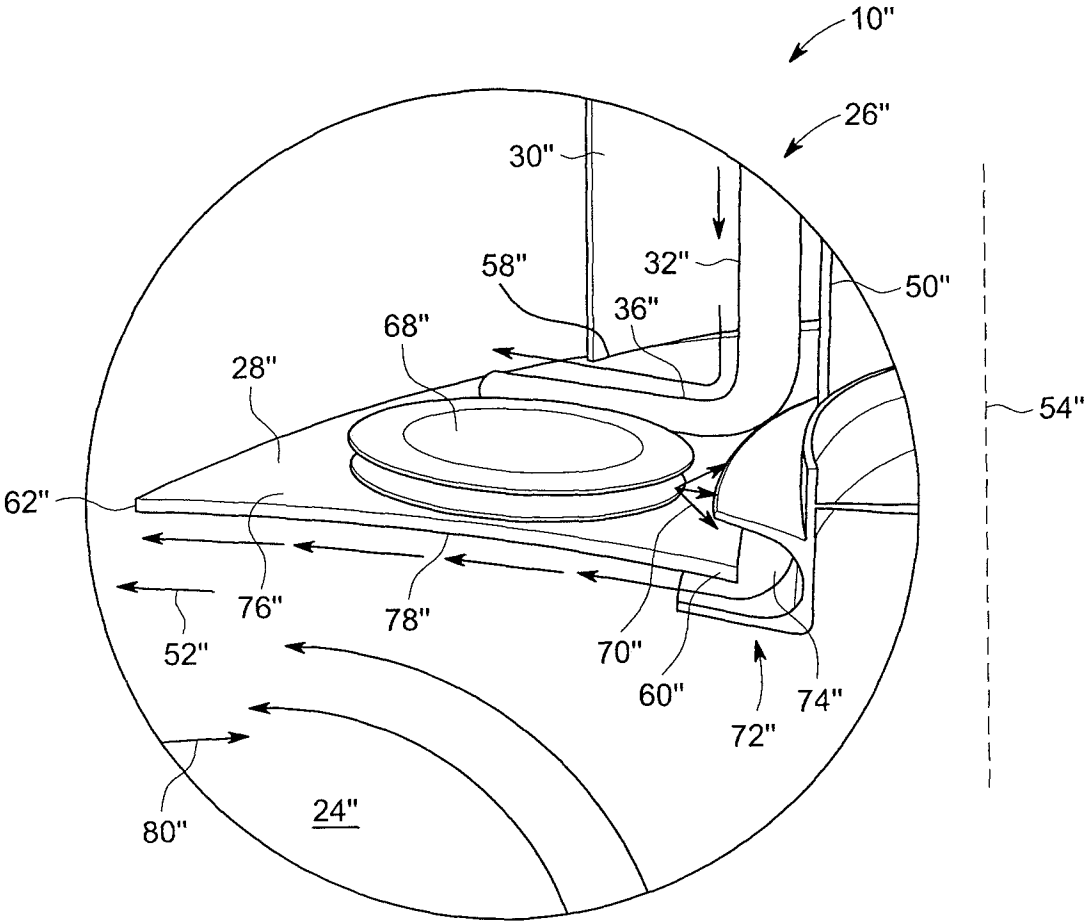
FIG. 5 is a perspective view of an alternative thermal dissipator of the heat transfer system for the LED lamp illustrated in FIG. 1.

FIG. 5 illustrates a heat transfer system 10" similar to the heat transfer system 10 illustrated in FIGS. 1-2, with an alternative thermal dissipator 26" positioned within the room 24". As with the heat transfer system 10 discussed above and illustrated in FIGS. 1-2, the heat transfer system 10" includes a heat transfer device 32" with a first end mounted to the board surface (not shown), and a second end 36" mounted to the thermal dissipator 26", to transfer the heat energy from the board surface to the thermal dissipator 26" and dissipate the heat energy from the thermal dissipator 26" within the room 24". As illustrated in FIG. 5, the system 10" includes an air flow device 68" which generates a flow of air 70" along the thermal dissipator 26", which is shaped/configured to direct the generated flow of air 70" from the air flow device 68" in an outward radial direction 52" over the thermal dissipator 26", to enhance the dissipation of the heat energy from the thermal dissipator 26" within the room 24". In an exemplary embodiment, the air flow device may be one of a fan, a piezo actuator or a synthetic jet as disclosed in U.S. Pat. No. 7,688,583, which is incorporated by reference herein.

More specifically, the thermal dissipator 26" includes a longitudinal surface 30" to extend in a direction parallel to a longitudinal axis 54" of the lamp body, from a first end coupled to the ceiling (not shown) to a second end 58" within the room 24". Additionally, the thermal dissipator 26" includes a radial surface 28" to extend in the outward radial direction 52" from a first end 60", to a second end 62" attached to the second end 58" of the longitudinal surface 30". The system 10" further includes a flow profile 72" attached to a base 50" of the load body. As illustrated in FIG. 5, the air flow device 68" is mounted on the first side 76" of the radial surface 28", between the radial surface 28" and the ceiling, to generate the flow of air in an inward radial direction 80" over the first side 76" of the radial surface 28". The flow profile 72" includes a redirecting channel 74", such that the first end 60" of the radial surface 28" extends within the redirecting channel 74", and the flow profile 72" redirects the generated flow of air 70" over a second side 78" of the radial surface 28" which is opposite to a first side 76" of the radial surface 28" facing the ceiling 20". The redirecting channel 74" is shaped to receive the generated flow of air 70" and to redirect the generated flow of air in the outward radial direction 52" over the second side 78" of the radial surface 28". As illustrated in FIG. 5, the redirecting channel 74" has a U-shaped profile, and the first end 60" of the radial surface 28" extends within the U-shaped profile, so that the generated flow of air 70" from the air flow device 68" is redirected from traveling in the inward radial direction 80" over the first side 76" of the radial surface 28", to the outward radial direction 52" over the second side 78" of the radial surface 28", to dissipate the heat energy from the radial surface 28". Those elements of the system 10" illustrated in FIG. 5, and not discussed herein, are similar to the elements of the system 10 discussed above, without prime notation, and require no further discussion herein.

Figure 6:
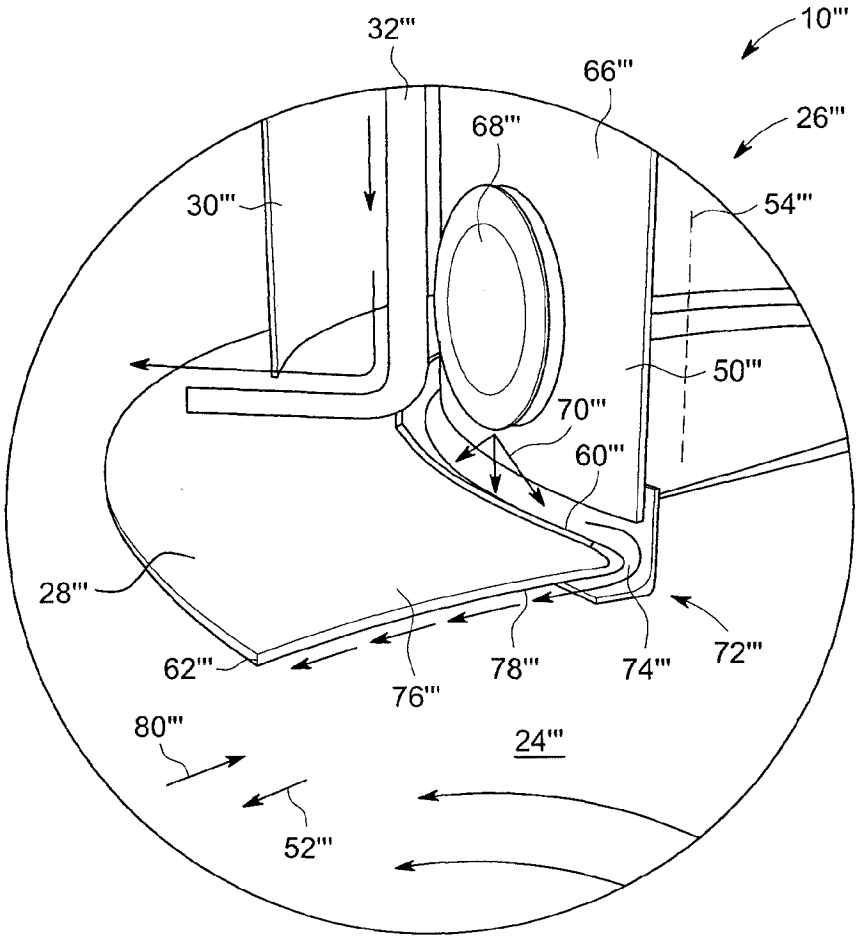
FIG. 6 is a perspective view of an alternative thermal dissipator of the heat transfer system for the LED lamp illustrated in FIG. 1.

FIG. 6 illustrates a heat transfer system 10'" similar to the heat transfer system 10" illustrated in FIG. 5, with an alternative thermal dissipator 26'" positioned within the room 24'". Unlike the system 10" illustrated in FIG. 5, in which the air flow device 68" is mounted to the first side 76" of the radial surface 28", the air flow device 68'" of the system 10'" is mounted on an exterior surface of the side wall 66'" of the lamp body, to generate a flow of air 70'" in a direction parallel to the longitudinal axis 54'" of the lamp body. As with the redirecting channel 74" illustrated in FIG. 5, the redirecting channel 74'" is shaped to receive the generated flow of air 70'" from the air flow device 68'" and to redirect the generated flow of air in the outward radial direction 52'" over the second side 78'" of the radial surface 28'". However, unlike the redirecting channel 74" illustrated in FIG. 5, the redirecting channel 74'" has an L-shaped profile, such that the first end 60'" of the radial surface 28'" extends within the L-shaped profile. Additionally, unlike the redirecting channel 74" illustrated in FIG. 5, which redirects the air in a U-shaped path from passing in the inward radial direction 80" along the first side 76" of the radial surface 28" to passing in the outward radial direction 52" along the second side 78" of the radial surface 28", the redirecting channel 74'" directs the air in an L-shaped path from passing along the side wall 66'" of the lamp body to along the second side 78'" of the radial surface 28", to dissipate the heat energy from the radial surface 28'" within the room 24'". Those elements of the system 10'" illustrated in FIG. 6, but not discussed herein, are similar to the elements of the system 10 discussed above, without prime notation, and require no further discussion herein.

Figure 7:
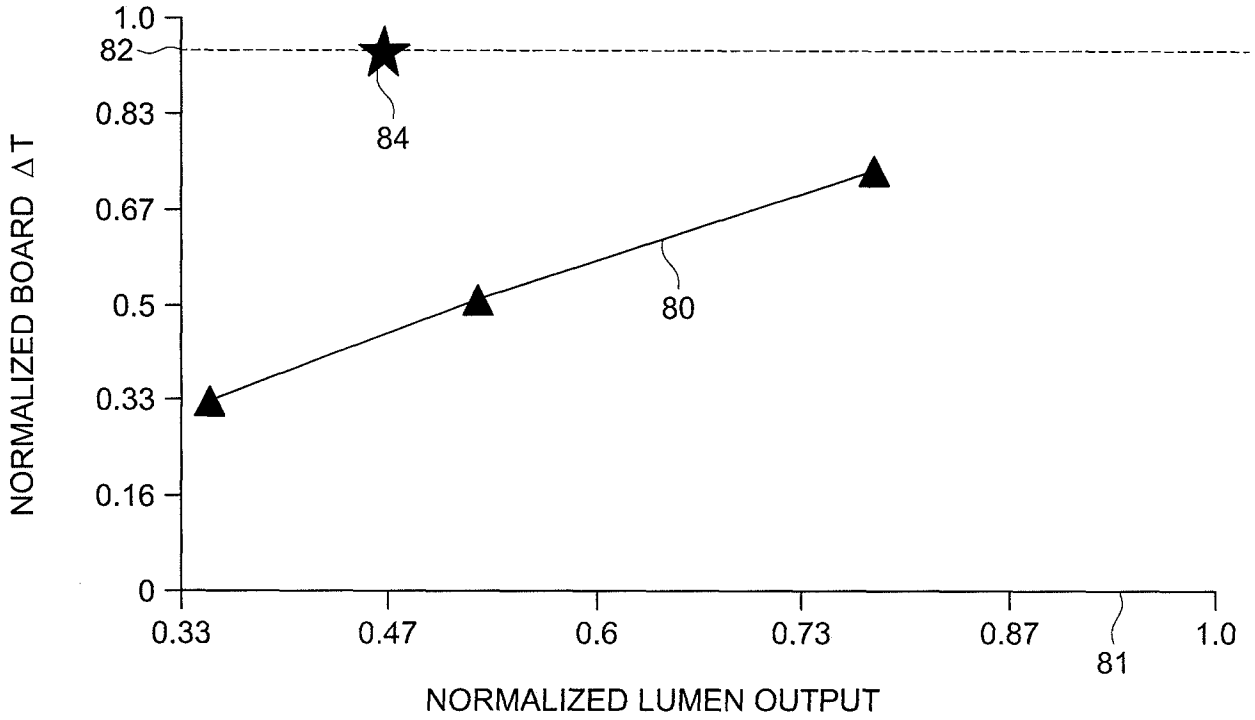
FIG. 7 is a plot of a change in a surface temperature versus lumen output for the heat transfer system illustrated in FIG. 5.

FIG. 7 illustrates a plot of a normalized temperature difference between the board surface and the room 24" (i.e., steady-state), using the system 10" discussed above, as well as the normalized temperature difference between the board surface and the room using a conventional thermal management system, as a function of a normalized lumen output of the LED lamp 12". In an exemplary embodiment, the normalized temperature difference between the board surface and the room 24" may be based on a temperature difference of 60 degrees Celsius, which occurs when the board surface temperature reaches 80 degrees Celsius and the room 24" temperature is 20 degrees Celsius, for example. In an exemplary embodiment, the normalized lumen output may be based on a lumen output of 1500 lumens, for example. As illustrated in FIG. 7, the normalized temperature difference experienced by the board surface within the system 10", including the arrangement of the thermal dissipator 26", flow profile 72", redirecting channel 74", and air flow device 68" is only 0.33 at a normalized lumen output of 0.3, and remains below the normalized maximum temperature difference 82 at a normalized lumen output of 0.8. As further illustrated in FIG. 7, the normalized temperature difference 84 experienced by the board surface within a conventional system reaches the normalized maximum temperature difference 82 at a normalized lumen output of 0.47. Thus, the system 10" is capable of generating a greater normalized lumen output than the conventional system, and more specifically, is capable of generating 50% more than the lumen output of the conventional system (i.e., 0.80 normalized output compared to 0.47 normalized output), while maintaining a lower surface temperature (i.e., lower normalized temperature difference).

Figure 8:
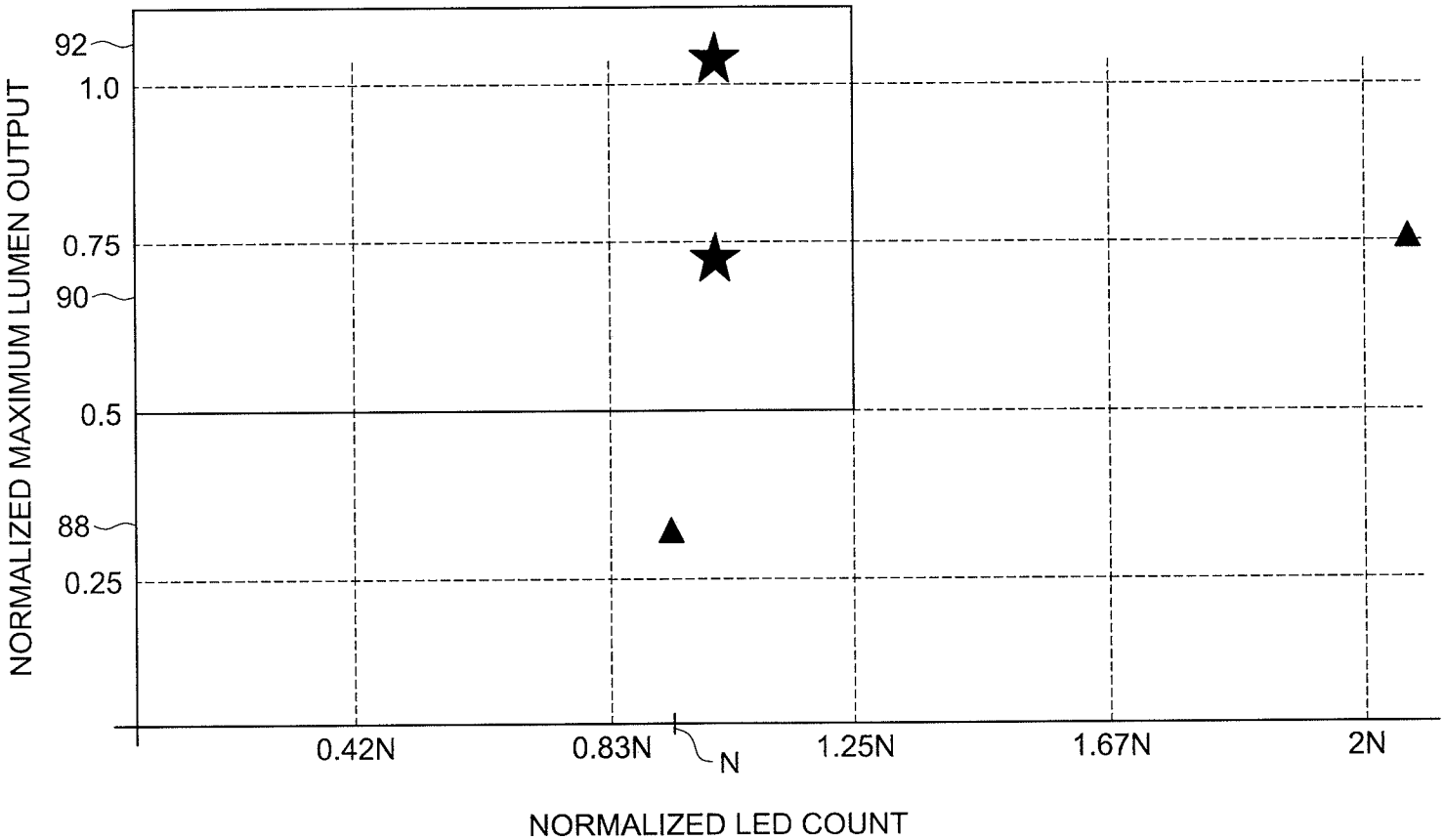
FIG. 8 is a plot of a maximum lumen output versus a minimum number of LEDs, for the heat transfer systems illustrated in FIGS. 5 and 6.

FIG. 8 a plot of a normalized maximum lumen output of the system 10" illustrated in FIG. 5, the system 10'" illustrated in FIG. 6, and a conventional system, versus the normalized minimum number of required LEDs within the LED lamp. In an exemplary embodiment, the normalized maximum lumen output of the system 10", system 10'" and conventional system is based on a maximum lumen output of 2000 lumens, for example. In an exemplary embodiment, the normalized minimum number of required LEDs within the LED lamp is based on a dozen LEDs, for example. As previously discussed, the cost of an LED lamp is directly related to the minimum number of required LEDs within the LED lamp, to output a desired lumen output. FIG. 8 illustrates a "high customer value zone," based on a minimum ratio of the normalized maximum lumen output to the normalized minimum number of LEDs (i.e., a ratio of the normalized minimum lumen output per normalized minimum number of required LED). For example, FIG. 8 illustrates that the "high customer value zone" requires a minimum ratio of 0.4 normalized maximum lumen output per the normalized required number (N) of LEDs. As illustrated in FIG. 8, the normalized maximum lumen output 88 of the conventional system is shown, for a normalized number N of LEDs, such as a dozen LEDs, for example. Additionally, FIG. 8 illustrates the normalized maximum lumen output 90 of the system 10", for the same normalized number N of LEDs as the conventional system. Additionally, FIG. 8 illustrates the normalized maximum lumen output 92 of the system 10'", for the same normalized number N of LEDs as the conventional system and the system 10". As shown from the plot of FIG. 8, the system 10'" is capable of operating at three times the normalized luminous output of the conventional system, while the system 10" is capable of operating at twice the luminous output of the conventional system, for the same normalized number N of LEDs. As previously discussed, since the system 10''' is capable of operating at three times the luminous efficiency of the conventional system, the system 10''' can output the same luminous output of the conventional system, with only one-third as many LEDs, thus reducing the cost of the LED lamp to the consumer, such as by one-third, for example. Similarly, as previously discussed, since the system 10'' is capable of operating at twice the luminous efficiency of the conventional system, the system 10'' can output the same luminous output of the conventional system, with only one-half as many LEDs, thus reducing the cost of the LED lamp to the consumer, such as by one-half, for example. Although FIG. 8 illustrates that the system 10'' and the system 10''' have a respective luminous efficiency which is twice and three times greater than the conventional system, this numeric example is merely exemplary, and the systems 10, 10', 10'', and 10''' need only have a luminous efficiency which is greater than the luminous efficiency of the conventional system, in order to reduce the required number of LEDs within the LED lamp, in order to reduce the cost of the LED lamp to the consumer.

Figure 9:
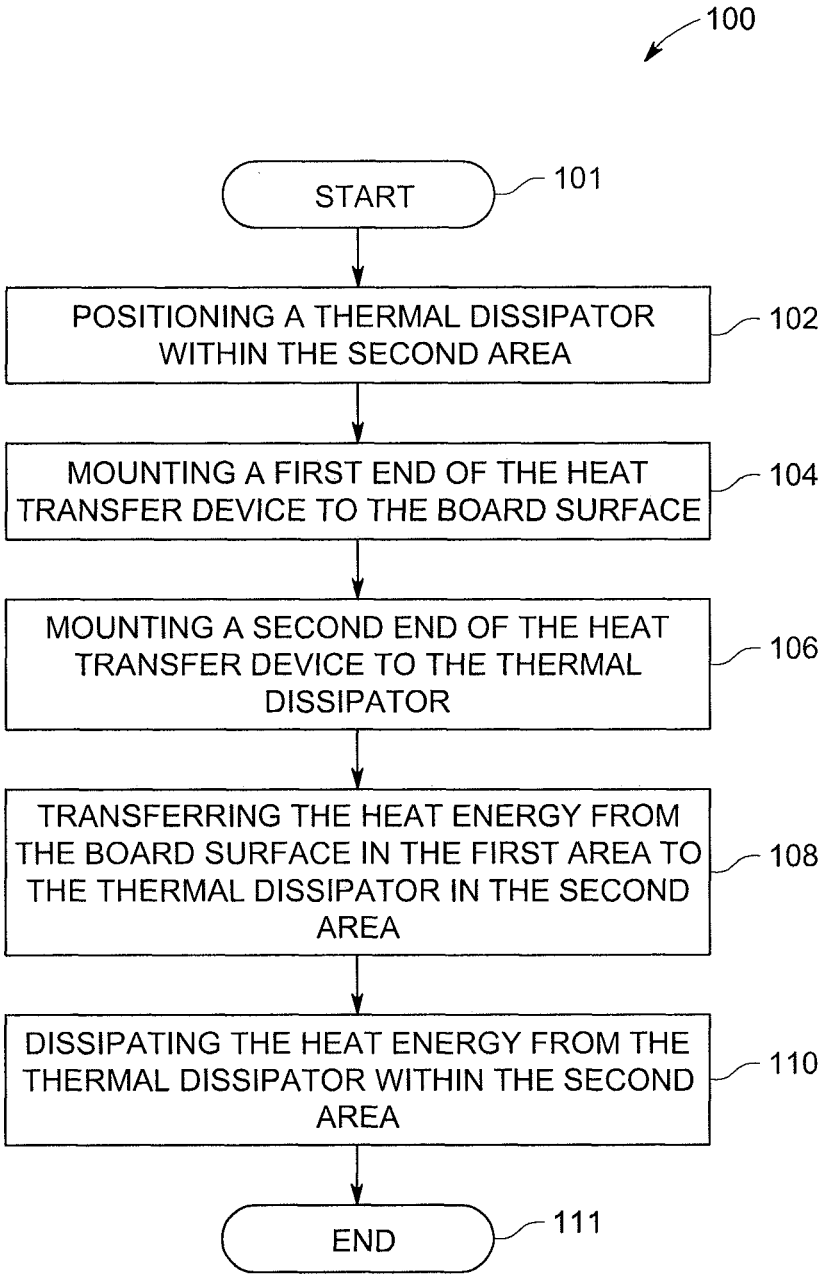
FIG. 9 is a flowchart depicting an exemplary embodiment of a method for transferring heat for a LED lamp in accordance with the present invention.

FIG. 9 illustrates a flowchart depicting a method 100 for transferring heat for the LED lamp 12 discussed in the above embodiments. The LED lamp 12 includes the board surface 14 to generate heat energy during the operation of the LED lamp 12. The LED lamp 12 is mounted within the recessed housing 16 to separate the first area 22 at the first temperature from the second area 24 at the second temperature, where the second temperature is less than the first temperature. The method 100 begins at 101 and includes positioning 102 a thermal dissipator 26 within the second area 24. The method 100 further includes mounting 104 a first end 34 of the heat transfer device 32 to the board surface 14. The method 100 further includes mounting 106 a second end 36 of the heat transfer device 32 to the thermal dissipator 26. The method 100 further includes transferring 108 the heat energy from the board surface 14 in the first area 22 to the thermal dissipator 26 in the second area 24. The method 100 further includes dissipating 110 the heat energy from the thermal dissipator 26 within the second area 24, before ending at 111.

This written description uses examples to disclose embodiments of the invention, including the best mode, and also to enable any person skilled in the art to make and use the embodiments of the invention. The patentable scope of the embodiments of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A heat transfer system for a light emitting diode (LED) lamp, said LED lamp comprising a board surface configured to generate heat energy during an operation of the LED lamp, said LED lamp positioned within a lamp body and mounted within a recessed housing for separating an attic having a first temperature from a room having a second temperature, said second temperature being lower than said first temperature, wherein the lamp body is mounted within the recessed housing at an opening in a ceiling of the room, said ceiling for separating the attic having the first temperature from the room having the second temperature, said system comprising:

a trim positioned within the room, wherein said trim comprises:

a longitudinal surface configured to extend in a direction parallel to a longitudinal axis of the lamp body, from a first end coupled to the ceiling to a second end within the room;

a radial surface configured to extend in the outward radial direction from a first end, to a second end attached to the second end of the longitudinal surface; and a flow profile attached to a base of the lamp body, said flow profile comprising a redirecting channel; said first end of the radial surface to extend within the redirecting channel, such that the flow profile is configured to redirect the generated flow of air over a second side of the radial surface, said second side being opposite to a first side of the radial surface facing the ceiling;

a heat pipe having a first end mounted to the board surface, and a second end mounted to the trim, to transfer the heat energy from the board surface to the trim and to dissipate the heat energy from the trim within the room; and an air flow device configured to generate a flow of air along the trim, said trim configured to direct the generated flow of air in an outward radial direction over the trim, to enhance the dissipation of the heat energy from the trim within the room.

2. The system of claim 1, wherein said air flow device is mounted on the first side of the radial surface, between the radial surface and the ceiling, to generate the flow of air in an inner radial direction over the first side of the radial surface; wherein said redirecting channel is shaped to receive the generated flow of air and to redirect the generated flow of air in the outward radial direction over the second side of the radial surface.

3. The system of claim 2, wherein said redirecting channel has a U-shaped profile, and said first end of the radial surface is configured to extend within the U-shaped profile.

4. The system of claim 1, wherein said air flow device is mounted on an exterior surface of the lamp body, to generate the flow of air in a direction parallel to the longitudinal axis of the lamp body; wherein said redirecting channel is shaped to receive the generated flow of air and to redirect the generated flow of air in the outward radial direction over the second side of the radial surface.

* * * * *